United States Patent [19]

Bronaugh, Sr. et al.

[11] Patent Number: 4,688,342

[45] Date of Patent: Aug. 25, 1987

[54] SHUTTLE DISPLAY APPARATUS

[76] Inventors: William R. Bronaugh, Sr., 6572 Cerulean Ave., Garden Grove, Calif. 92645; William B. Atkinson, 20467 Cherrygate La., Yorba Linda, Calif. 92686

[21] Appl. No.: 785,602

[22] Filed: Oct. 8, 1985

[51] Int. Cl.[4] ..... G09F 11/30

[52] U.S. Cl. ..... 40/511; 40/476

[58] Field of Search ..... 40/476, 511, 487, 488, 40/489, 490, 491, 508, 509, 510, 446

[56] References Cited

U.S. PATENT DOCUMENTS

| | | | |
|---|---|---|---|
| 1,125,393 | 1/1915 | Proulx | 40/511 |
| 1,224,512 | 5/1917 | Teetor | 40/511 |
| 1,528,344 | 3/1925 | Roberts | 40/476 |
| 1,611,926 | 12/1926 | McDonald | 40/476 |
| 1,707,158 | 3/1929 | Brown | 40/511 |
| 1,716,582 | 6/1929 | Gilford | 40/511 |
| 3,797,144 | 3/1974 | Weggeland | 40/476 |

FOREIGN PATENT DOCUMENTS

| | | | |
|---|---|---|---|
| 1320843 | 2/1963 | France | 40/511 |
| 280587 | 12/1930 | Italy | 40/511 |
| 186706 | 10/1922 | United Kingdom | 40/476 |

*Primary Examiner*—Robert P. Swiatek
*Assistant Examiner*—J. Hakomaki
*Attorney, Agent, or Firm*—Fulwider, Patton, Rieber, Lee & Utecht

[57] ABSTRACT

A shuttle display apparatus including a base formed with multiple sets of pairs of parallel lateral tracks connected together on their opposite ends by respective longitudinal shuttle tracks. Display panels are racked together for translinear travel progressively in such lateral tracks to selectively display, in coplanar relationship, the respective front sides of a pair of such panels in one direction and to thereafter selectively display the back sides of such panels in coplanar relationship in the opposite direction. A drive is provided for automatically advancing a pair of panels along a pair of lateral tracks and then shuttling one panel of the pairs to an adjacent pair of lateral tracks to dispose such pair of panels abreast of one another in a coplanar displaying position for displaying composite messages in one direction or another.

5 Claims, 20 Drawing Figures

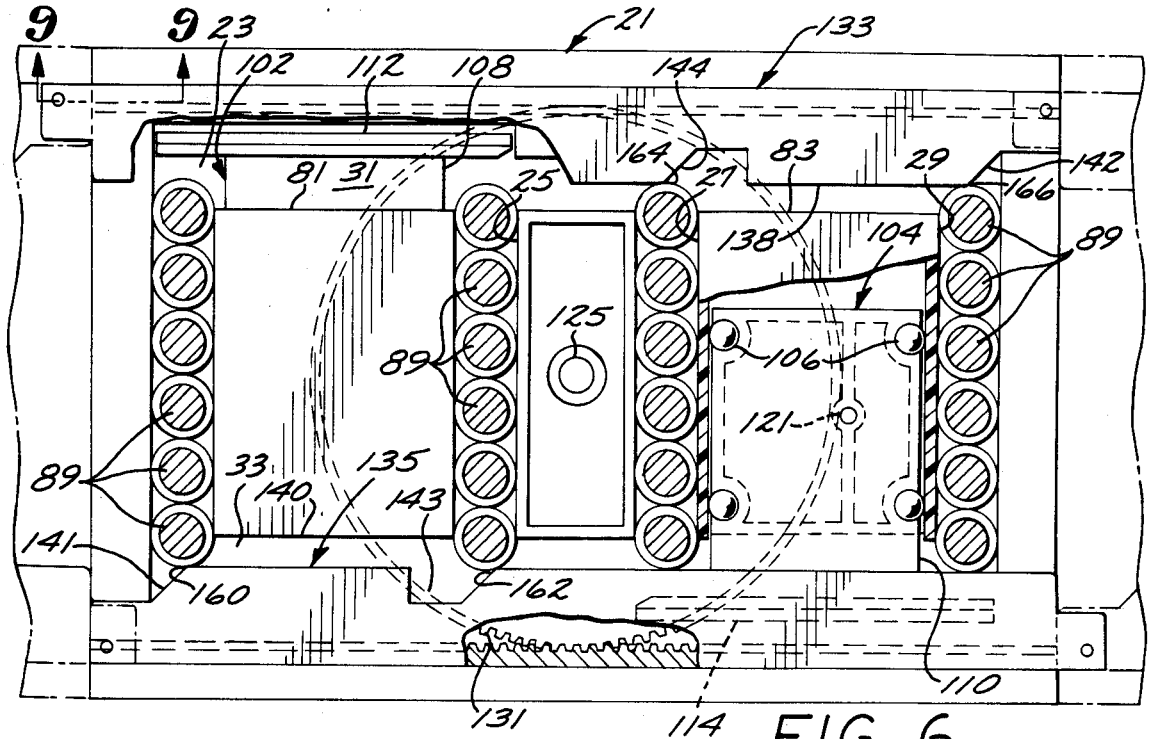
FIG. 6
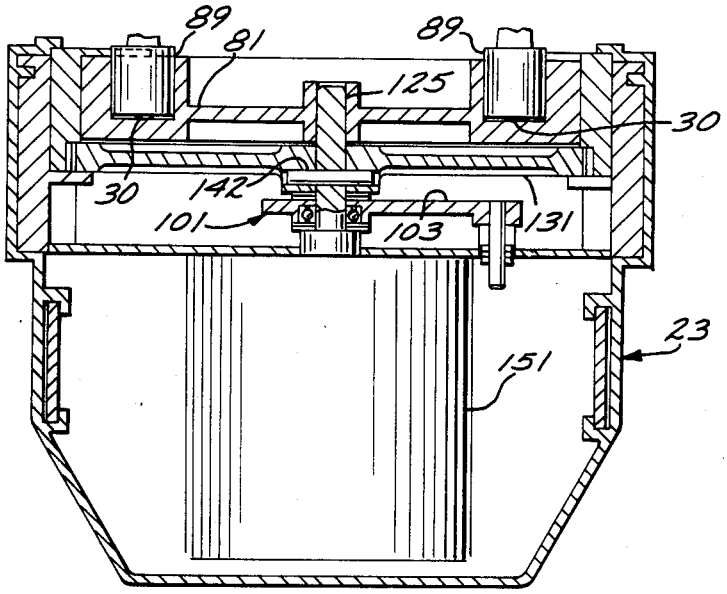
FIG. 7
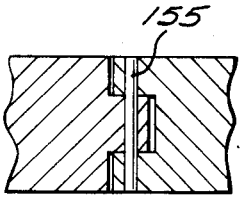
FIG. 9
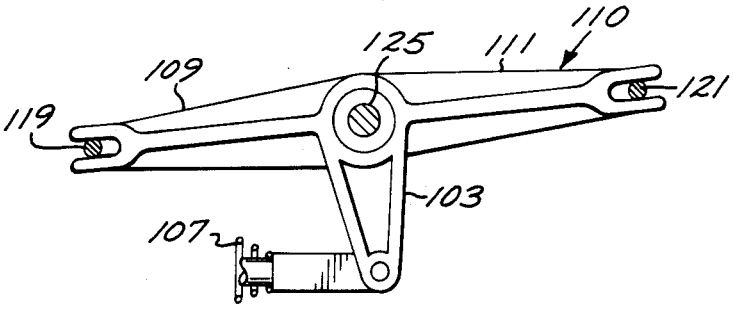
FIG. 8
FIG. 10
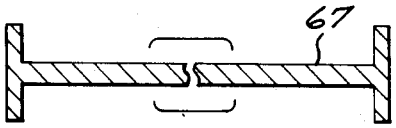

SHUTTLE DISPLAY APPARATUS

BACKGROUND OF THE INVENTION

1. Field of the Invention

The present invention relates to automatically changeable display signs.

2. Description of the Prior Art

It has long been recognized that visual display of advertising material to high concentrations of the purchasing public has substantial benefit in promoting the message or product being advertised. Consequently, there is a great demand for placement of visual advertising at locations frequented by the purchasing public. Due to the space limitations for advertising, as by billboards located along a frequently travelled thoroughfare or at public gatherings, great efforts have been made to provide display means which is effective to sequentially display different advertising messages to the assembled public or passerby.

Such efforts have led to the development of display devices which present elongated parallel prisms disposed in side-by-side relationship for selective rotation in unison to sequentially display the three faces of the respective prisms for exposing advertising indicia located on such faces to thereby exhibit a composite message or advertisements. A device of this type is shown in U.S. Pat. No. 4,073,081. While satisfactory for its intended purposes, devices of this type suffer the shortcoming that they are restricted in their capacity to store and display different messages.

Other efforts have led to the development of devices which incorporate scrolls having multiple advertisements thereon but such devices suffer the shortcoming that they are relatively unwieldly, expensive to install and are subject to damage from weather and climatic conditions. One example of these styles of devices is shown in U.S. Pat. No. 4,489,514.

Other devices have been proposed which incorporate a carrousel, or rotary panel arrangement, such as that shown in U.S. Pat. Nos. 3,696,536, 1,294,130, 1,050,936, 801,133, 793,348, 793,701 and 522,979. Many of the devices shown in these patents suffer the shortcoming that they are limited in capacity and incorporate relatively complex mounting and drive mechanisms which are expensive to manufacture and have frequently proven unreliable in operation.

SUMMARY OF THE INVENTION

The shuttle display apparatus of the present invention is characterized by a base having a plurality of laterally extending tracks which are connected together at their opposite ends by means of shuttle tracks. A plurality of pairs of display panels are racked together on individual carriages traveling in such tracks such that the display panels are arranged in columns on the lateral tracks and may be sequentially advanced from one side to the other along the lateral tracks, shuttled between such tracks and then sequentially retracted to the opposite side of the tracks. In this manner, composite displays on the sides of the panels exposed simultaneously to one side or the other of the base may carry a composite message for observation by viewers viewing the display device.

Other objects and features of the invention will become apparent from consideration of the following description taken in connection with the accompany drawings.

BRIEF DESCRIPTION OF THE DRAWINGS

FIG. 6 is a horizontal sectional view, partially broken away, taken along the line 6—6 of FIG. 3;

FIG. 7 is a vertical sectional view taken along the line 7—7 of FIG. 3;

FIG. 8 is a horizontal sectional view taken along the line 8—8 of FIG. 3;

FIG. 9 is a vertical sectional view taken along the line 9—9 of FIG. 6;

FIG. 10 is a broken horizontal sectional view, in enlarged scale, taken along the line 10—10 of FIG. 3;

DESCRIPTION OF THE PREFERRED EMBODIMENT

Figure 1:
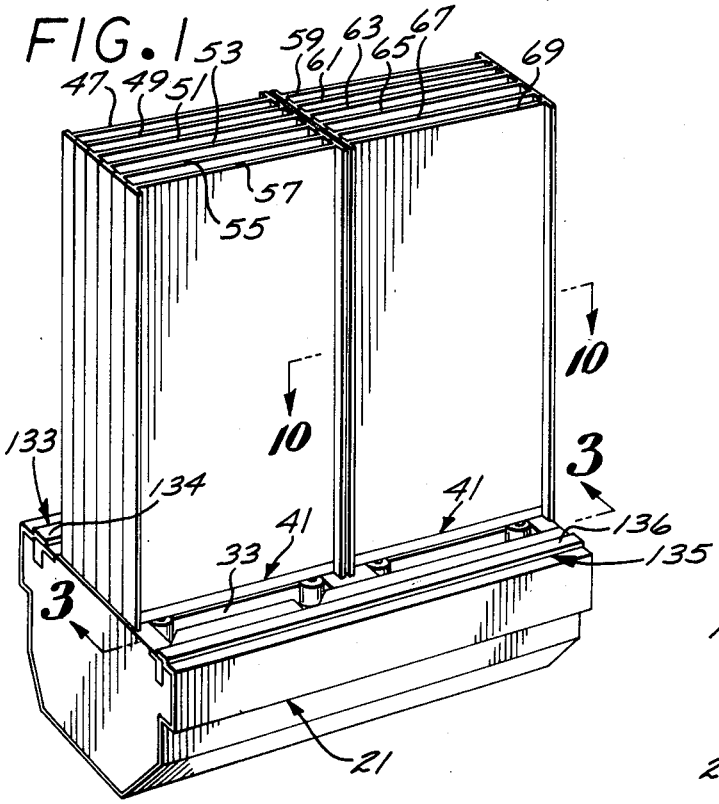
FIG. 1 is a perspective view of the shuttle display apparatus embodying the present invention.
Figure 2:
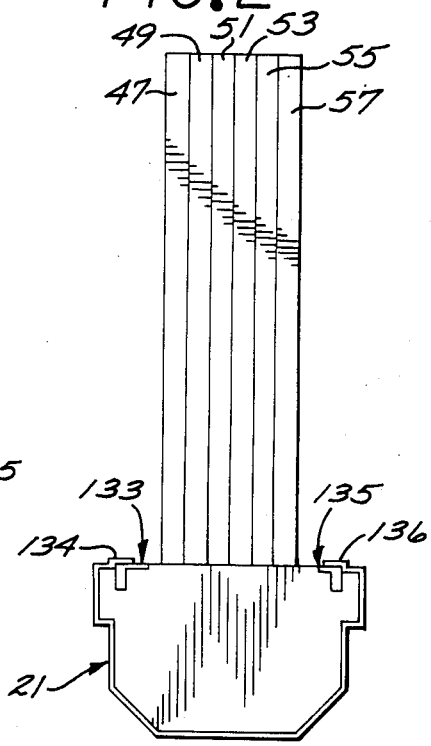
FIG. 2 is a lefthand end view of the shuttle display apparatus shown in FIG. 1.

The shuttle display apparatus of the present invention includes, generally, a base 21 having formed therein first and second pairs of lateral tracks 23, 25, 27 and 29 (FIG. 3) joined together on their opposite ends by means of respective shuttle tracks 31 and 33 (FIG. 6). Carried in the tracks 23, 25, 27 and 27 are first and second racks of carriages, generally designated 41 (FIG. 3), which mount respective vertical display panels 47–69 (FIG. 1). A drive mechanism, generally designated 71 (FIG. 3), is operative to selectively advance the panels 47–55 of the first rack of panels forwardly in the tracks 23 and 25 and to selectively shuttle the front panel, as for instance panel 55, from the lefthand rack as viewed in FIG. 1 to the righthand rack traveling in the tracks 27 and 29. The panels 61–69 of the righthand rack are retracted in the tracks 27 and 29 and the back panel, as for instance panel 57, shuttled to the back of the lefthand column. Thus the front faces of pairs of panels, such as 57 and 69, are displayed forwardly for a selected time, followed by the front faces of sequential pairs 55 and 53, 51 and 49, etc.

The base 21 may be constructed of any desirable material and is preferably constructed in modular form such that modules of such base may be connected together in end-to-end relationship to thereby enable display of multiple pairs of columns of panels 47–66. In the preferred embodiment, the lateral tracks 23, 25, 27 and 29 are in the form of grooves (FIG. 3) formed in the top wall of the base 21, each pair being separated by means of respective hollow boxlike raised platforms having top walls 81 and 83 which form tray-receiving respective chambers 82 and 84 thereunder as disclosed hereinafter.

The carriages 41 are in the form of upwardly opening channels 85 mounted on respective cylindrical followers 89 received in the respective tracks 23, 25, 27 and 29 and riding on respective roller bearings 30 (FIGS. 1, 3, 4 and 6).

Figure 5:
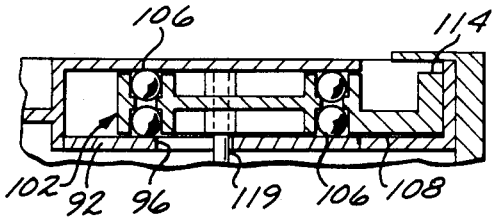
FIG. 5 is a vertical sectional view taken along the line 5—5 of FIG. 3.

The bottoms of the tray chambers 82 and 84 are closed by means of respective bottom walls 92 and 94 (FIGS. 3 and 4) formed centrally with short laterally projecting through slots 96 and 98. Received within the chambers 82 and 84 and riding on the bottom walls 92 and 94 are respective escort trays generally designed 102 and 104 (FIGS. 5 and 6). The escort trays 102 and 104 are formed in the four corners with respective upwardly and downwardly opening ball bearing cavities which receive respective ball bearings 106 (FIGS. 5 and 6) that project from the bodies of such trays to ride on the respective bottom walls 92 and 94 and to engage the top walls 81 and 83 to carry and guide such trays in their lateral travel. The trays 102 and 104 are formed at their respective back and front ends (FIGS. 5 and 6) with respective laterally projecting tongues 108 and 110 aligned with the floor of the shuttle tracks 31 and 33. The tongues 108 and 110 are turned upwardly at their respective outer extremities to form respective longitudinal pushers 112 and 114 which serve to push the followers 89 selectively from the shuttle track to the lateral tracks 23–29 as will be described hereinafter.

Referring to FIGS. 5 and 6, it will be appreciated that the tongues 108 and 110 cooperate with the respective pushers 112 and 114 when the trays 25 and 27 are in their extended positions to form respective segments of the shuttle tracks 31 and 33 such that the followers 89 may travel longitudinally to their respective positions aligned with the lateral tracks 23, 25, 27 and 29.

Figure 3:
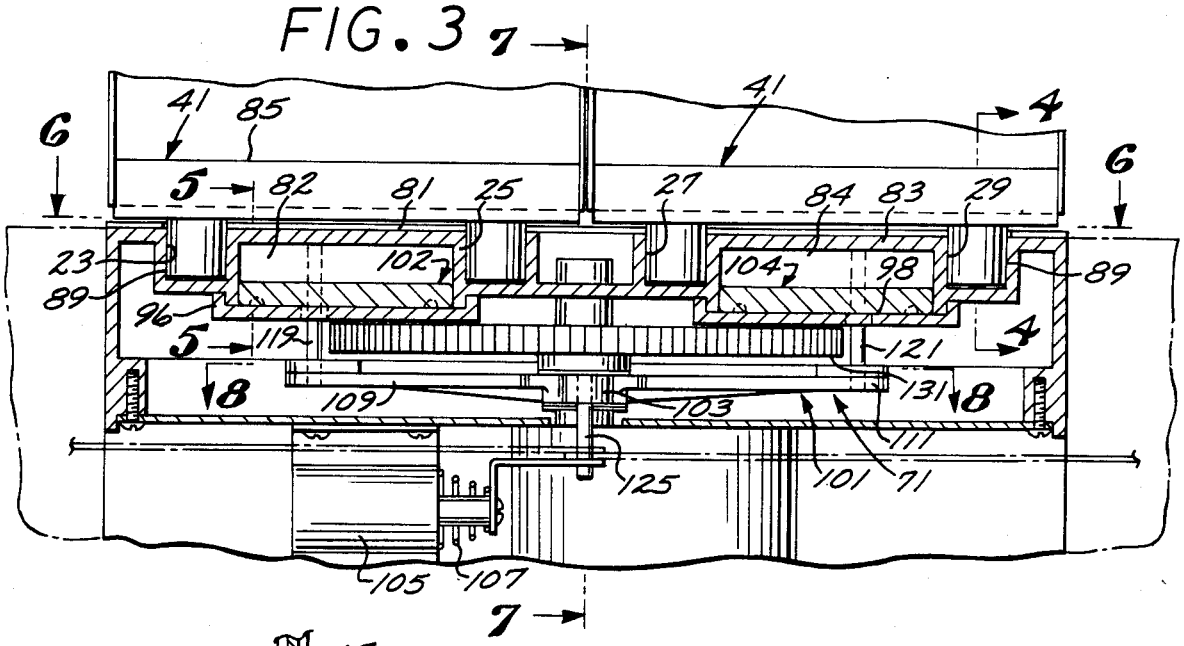
FIG. 3 is a longitudinal sectional view, in enlarged scale, taken along the line 3—3 of FIG. 1.
Figure 4:
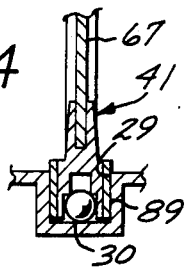
FIG. 4 is a vertical sectional view taken along the line 4—4 of FIG. 3.

Mounted within the base 21 and forming a part of the drive 71 is a T-shaped bell crank, generally designated 101 (FIG. 8) having its lateral arm 103 connected with an electric solenoid 105 (FIG. 3) and biased to the right as viewed in FIGS. 3 and 5 by means of a compression coil spring 107. Diammetrically oppositely extending bell crank arms 109 and 111 are formed on their distal ends with respective forks which receive respective vertical drive pins 119 and 121 which project upwardly through the lateral slots 96 and 98 (FIG. 3) formed in the bottom walls 92 and 94 to drive the respective trays 102 and 104. The bell crank 101 is carried freewheeling on a powered axle 125 (FIG. 8) which also mounts an external ring gear 131 sandwiched between such bell crank and the bottom walls 92 and 94.

The opposite sides of the ring gear 131 mesh with gear racks formed on the inside of vertical flanges of angle shaped draw bars, generally, designated 133 and 135, (FIG. 6), carried slidably on the opposite lateral edges of the base. The draw bars 133 and 135 are in the form of angles held slidable in position on the base 23 by means of respective horizontal hold down slats defined by longitudinal inturned lips 134 and 136 formed by the opposite sides of a cover defining the housing for the base 21.

In the embodiment shown, the right and left racks of carriages 41 are formed by six carriages. The horizontal flanges of the draw bars 133 and 135 project inwardly and overlie the pushers 112 and 114 to terminate in horizontally spaced apart edges 138 and 140. The confronting edges 138 and 140 of such horizontal flanges are spaced apart a distance substantially equal to the combined major diameters of the followers 89 such that such edges will serve to hold such followers, and consequently the panels 47–69, firmly in position as described hereinafter.

Figure 11:
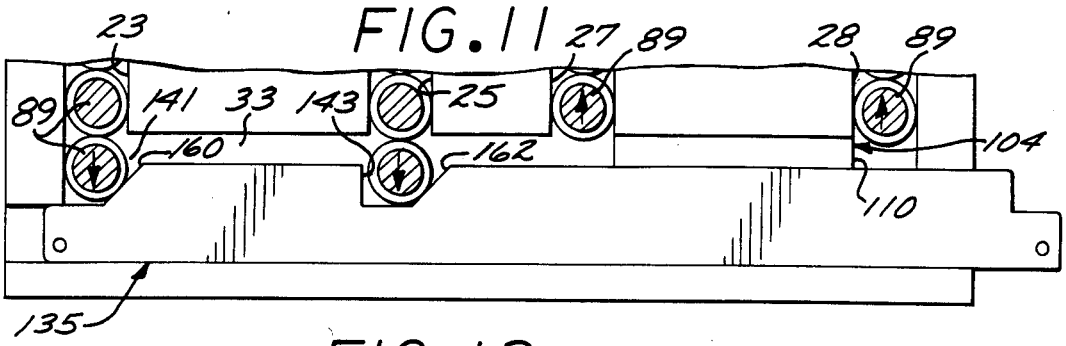
FIGS. 11, 12 and 13 are partial horizontal sectional views, similar to FIG. 6; and FIGS. **14*a*–14*g* are diagrammatic views depicting travel of display panels of the type incorporated in the shuttle display apparatus shown in FIG. 1**.

Referring to FIGS. 1–13, the horizontal flanges of the respective draw bars 133 and 135 are formed on the interior edges 138 and 140 with respective inwardly opening receiving notches 141 and 143 and 142 and 144 spaced longitudinally apart a distance corresponding with the distance between the pairs of tracks 23–25 and 27–29 and having a depth sufficient to receive therein approximately one-half the cross section of the followers 89 (FIG. 11). This enables a pair of such followers to move forwardly from the pairs of tracks 23–25 into their loading position in the shuttle track 33 and rearwardly from the pairs 27–29 into the shuttle track 31 when such notches are formed along their respective one sides with chamferred leading edges 160, 162, 164 and 166.

Mounted within the base 23 is a step motor 51 (FIG. 7) having its armature coupled with the drive pin 125 which is, in turn, keyed to the ring gear 131 by means of a transverse key 146. Reciprocation of the ring gear 131 serves to reciprocate the draw bars 133 and 135 in opposite direction from a locked or holding position to their loading positions registering the notches 141–144 with the respective lateral tracks 23–29 to receive the followers 89 and shuttle them to the opposing pair of tracks for receipt therein.

Referring to FIGS. 6 and 9, the ends of the draw bars 133 and 135 are formed with a tongue and clevis style arrangement connected together by means of a connector pin 155 such that modules of shuttle display sign devices of the present invention may be coupled together in end to end relationship whereby draw bars of adjacent modules may be driven by a single reversible step motor 151 to thereby minimize the expense of the drive system and positively assure synchronization between all modules driven by a common drive.

In operation, it will be understood that pairs of the display panels 47–67 which are simultaneously displayed to one side of the base 23 will typically incorporate segments of a common visual display such that the panels together exhibit a composite display. It will be appreciated that the number of modular bases 23 necessary for displaying the entire composite display may be coupled together such that the display panels mounted thereon will cooperate to form the overall length of composite display area necessary for the message to be displayed.

Referring to FIG. 1, assuming the front side of the pair of display panels 57 and 69 incorporate segments of a common message and that the back sides of the pair of display panels 47 and 59 display segments of a different common message, those common messages will be displayed to viewers for a predetermined period of time while the panels are in the position shown in FIG. 1. It will be appreciated that for each subsequent pair of panels, as for instance pairs of panels 55 and 53 and 61 and 63 in the respective right and lefthand racks (FIG. 1) will serve to display the segments of their common message on the front and back sides, respectively.

Shifting of the display panels 47–69 from the lateral tracks 23–29, along the shuttle tracks 31 and 33 back into the opposite pair of lateral tracks will now be described in detail. It will be appreciated that as long as the draw bars 133 and 135 remain in the locked position shown in FIG. 6, inside longitudinal bearing edges of the draw bars serve to hold the followers and, consequently, the front panels 57 and 69 and back panels 47 and 59 positively in position to securely display the composite messages thereon. When it is desirable to shift a new set of panels into position, as for instance panels 61 and 63 into coplanar relationship at the back of the base and the panels 53 and 55 into coplanar relationship at the front of the base, the step motor 151 will be actuated to rotate the ring gear 131 through a short arc counterclockwise as viewed in FIG. 6 to shift the draw bars to their loading position. Such rotation of the ring gear will drive the draw bar 135 a short distance to the right (FIG. 6) and the draw bar 133 a short distance to the left to thereby register the notches 141 and 143 of the draw bar 135 with the front, or exit, ends of the lefthand pair of tracks 23 and 25 and the notches 142 and 144 with the back ends of the pair of tracks 27 and 29. The bell crank drive solenoid 105 is then actuated momentarily to enable the coil spring 107 to rotate the bell crank 101 counterclockwise to advance the lefthand tray 102 and pusher 112 while retracting the righthand tray 104 and pusher 114. This serves to push the followers 89 of the panel 57 from the tracks 23 and 25 to be received partially in the notches 141 and 143 viewed in FIG. 11 while pushing the followers 89 rearwardly in the tracks 27 and 29 to cause the rearmost pair of followers 89 of the panel 59 to be received in their loaded position in the notches 142 and 144 disposed in the shuttle track 31.

Figure 12:
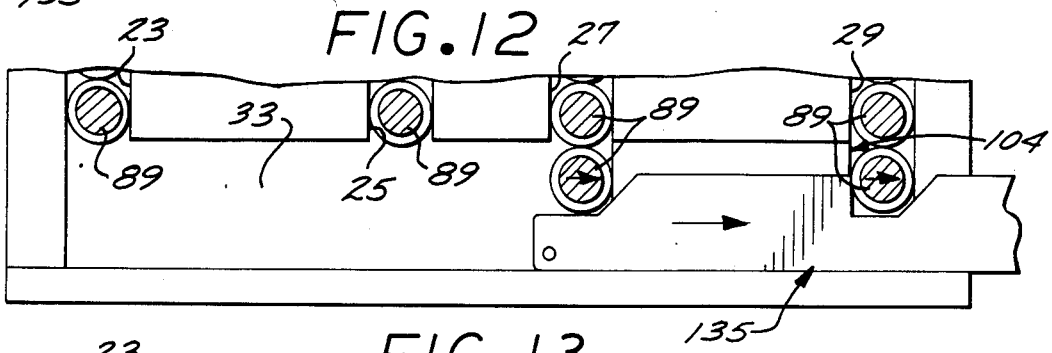
Figure 13:
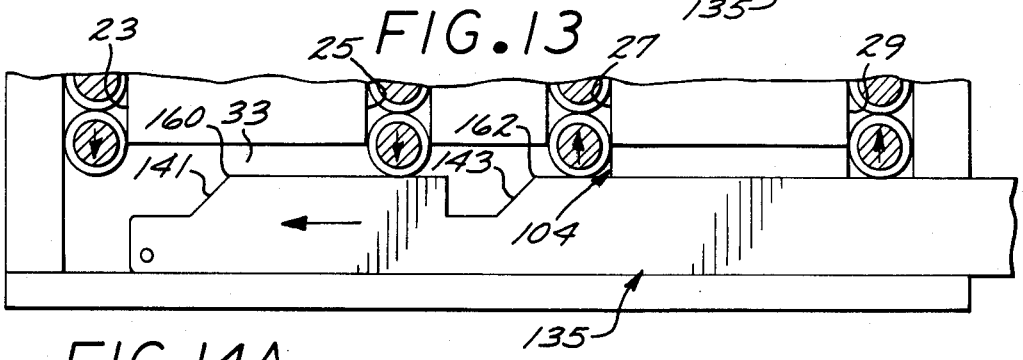

With the followers 89 so loaded into the notches 141–144, the step motor 151 is rotated to its next control position to shift the draw bars to their unloading position shown in FIG. 12 with the notches 141 and 143 registered with the front, or exit, ends of the lateral tracks 27 and 29 as shown in FIG. 12. Simultaneously, the notches 142 and 144 of the rearward rack 133 will be registered with the lefthand lateral tracks 23 and 25.

The bell crank solenoid motor 105 is then again actuated momentarily to enable the spring 107 to rotate the bell crank 110 counterclockwise as viewed in FIGS. 6 and 8 to again shift the lefthand drive tray forwardly in the base 21 and the righthand drive tray 104 rearwardly in such base thereby causing the pusher bars 112 and 114 to push the followers 89 of the forwardly and rearwardly respective panels 59 and 57 from the respective shuttle tracks 31 and 33 and into the respective pairs of tracks 23–25 and 27–29 to unload the rollers. It will be apparent to those skilled in the art that the rollers 89 of the carriages 41 now disposed at the front end of the track 23 and 25 and at the back end of the tracks 27 and 29 are held in position in such tracks by friction. The step motor 151 is then reversed to its next control position thus rotating the ring gear 131 clockwise to drive the draw bar 135 to the left as viewed in FIG. 13 to its loading position and the rear draw bar 133 to the right a distance sufficient to cause the notches 141 and 143 of the front draw bar 135 to register with the lateral tracks 23 and 25 and the notches 142 and 144 of the rear draw bar 133 to register with the tracks 27 and 29.

Should any of the rollers 89 have moved forward slightly from the front ends of the tracks 23 and 25 or rearwardly from the tracks 27 and 29, the chamferred lead edges 160 and 166 (FIG. 6) will be operative to push them back in the lateral tracks to clear the draw bars. It will be appreciated that the bell crank 110 is then again operated to advance the next pair of rollers 89 from the tracks 23 and 25 corresponding with the panel 55 into the notches 141 and 143 of the draw bar 135 and to retract the tray 104 to cause the pusher bar 114 to drive the followers 89 of the tracks 27 and 29 rearwardly to engage the rearmost pair of followers 89 corresponding with the panel 61 with the notches 142 and 149. Again, the step motor 151 is operated to rotate the ring gear 131 counterclockwise to translate the rollers 89 for the display panel 55 to the right as viewed in FIGS. 1 and 12 to the loading position aligned with the tracks 27 and 29.

Again, the bell crank 110, acting through the escort trays 102 and 104 is operated to retract the rows of followers 89 in the pair of tracks 27 and 29 and to advance the followers 89 in the tracks 23 and 25 then pushing the rollers of the panels 55 and 61 from the shuttle track into such respective pairs of lateral tracks. The step motor 151 is then reversed to drive the draw bars 133 and 135 to their locked positions shown in FIG. 6 to thus engage the respective locking abutments 160, 162, 164 and 166 formed at the interior ends of the ramps defining one side of the respective notches 141–142 to thus lock the rollers 89 and, consequently, the panels 47–69 positively in position. The draw bars are then held in this locked position for a predetermined period of time, as for instance 60 seconds, with the message segments on the backside of the panels 61 and 63 and the display segments on the front sides of the panels 53 and 55 are disposed as a composite message.

In the preferred embodiment the parallel tracks 23, 25 and 27–29 serve to hold the panels 47–69 parallel to one another for compact storage and viewing in abreast pairs. However, it will be appreciated by those skilled in the art that other well known mechanisms, such as slot, slider and cam arrangements might be employed to serve this function. It will be appreciated that the panel 53 has been now moved to the front of the lefthand rack and the panel 55 to the front of the righthand rack (FIG. 1). Likewise, the display panels 61 and 63 are disposed abreast of one another in coplanar relationship at the back of the base 21.

Figure 14A:
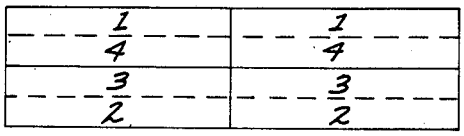
Figure 14B:
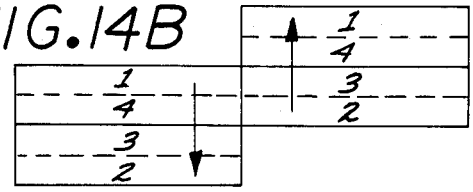
Figure 14C:
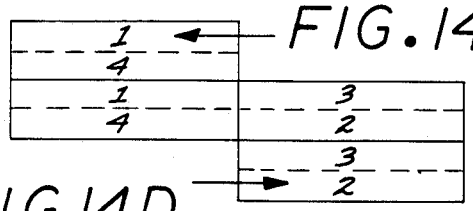
Figure 14D:
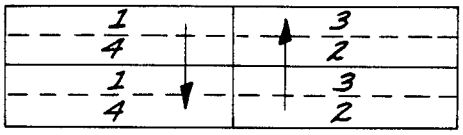
Figure 14E:
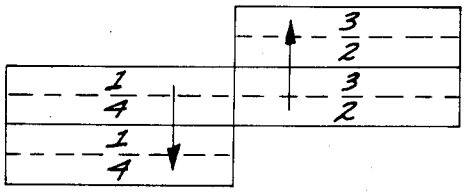
Figure 14F:
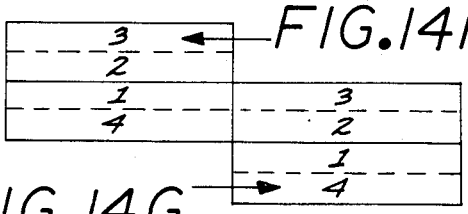
Figure 14G:
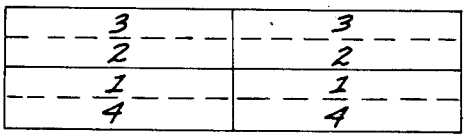

The steps set forth above are depicted diagrammatically in FIGS. **14*a*–14*g* for only four display panels. The common side of the display panel facing rearwardly is represented by the numeral 1 for the pair of panels disposed in side by side relationship and the front side of the first pair of such panels is represented by the numeral 4. Likewise, the front side of the second pair of panels is depicted by the numeral 2 and the rear side thereof depicted by the numeral 3. The first operation of advancing the left hand panels forwardly in the lefthand pair of tracks and retracting the righthand track of panels rearwardly in the righthand tracks is depicted in FIG. 14*b*. FIG. 14*c* represents lateral shuttling of the foremost and rearmost panels. FIG. 14*d* represents advancement of the lefthand rack of panels and retracks into the righthand rack of panels. FIG. 14*e* represents retraction of the righthand rack of panels to dispose the rearmost panel in the shuttle track and advancement of the lefthand rack of panels to dispose the foremost panel in the forward shuttle track. FIG. 14*f* depicts shuttling of the foremost and rearmost panel. FIG. 14*g* depicts the new display faces 33 and 44** disposed in coplanar relationship facing rearwardly and forwardly of the display device.

After the predetermined display period, the entire sequence may be initiated again to advance the front faces of the pair of panels 49 and 51 for viewing from the front and retracting the pair 65 and 67 for viewing from the rear. This process will then be repeated until all the different messages have been displayed and, if desired, the entire cycle then reinitiated. It will be recognized by those skilled in the art that any commercially available controls may be employed to control this operation and that a computerized program is most adaptable to the system.

From the foregoing it will be appreciated that the shuttle display apparatus of the present invention provides an economical and convenient means for displaying a nearly unlimited number of composite messages both in the forwardly and rearward directions. The length of display time may conveniently be programmed into the system and the display panels easily changed for the purposes of changing the messages displayed thereon.

Various modifications and changes may be made with regard to the foregoing detailed description without departing from the spirit of the invention.

We claim:

1. Shuttle display apparatus for displaying a plurality of pairs of display slats in side by side relationship such that complemental segments of a display will cooperate in forming a series of component visual displays, said apparatus comprising:

an elongated base formed with, at least, first and second pairs of channel shaped, upwardly opening, longitudinally spaced apart parallel lateral tracks having respective bottom walls with opposed side walls defining respective roller-receiving passages, said tracks having respective entry ends and exit ends;

a set of pairs of carriages for mounting such pairs of display slats in such side by side relationship and arranged for disposition in a pair of rows over each pair of tracks and to advance along said tracks, each carriage including a pair of downwardly projecting followers sized to closely fit in said passages for travel therealong, said followers being so configured and sized and sufficient in number to cooperate, when abutted together, with said carriages in said rows to exhibit an overall length occupying the length of the respective lateral tracks;

first and second longitudinal shuttle track means disposed at the respective entry and exit ends of said lateral tracks and extending therebetween to form shuttle track passages for receipt of said followers;

first and second draw bars disposed slidably along the respective outsides of the respective first and second shuttle tracks for reciprocation longitudinally relative thereto from respective receiving positions to respective feed positions, said draw bars being formed with respective pairs of notches opening inwardly toward said lateral tracks for, when said draw bars are in said receiving position, registering with the respective exit ends of said pairs of lateral tracks and to, when said bars are in said respective feed positions, align with said respective entry ends of said lateral tracks;

first and second escort tray means mounted from said base for reciprocation laterally inwardly and outwardly between respective outward loading positions and inward transfer positions and including pushers aligned with said entry ends of said lateral tracks and disposed such that when said escort trays are in said loading positions, they are clear of said respective shuttle track passages and to, as said trays are shifted from said loading to said transfer positions, pass laterally across said respective shuttle track passages to engage followers positioned at said entry ends of said lateral tracks and drive them positively into the confronting passages clear of said shuttle tracks;

drive means mounted to said base and coupled with said draw bars and escort tray means to cycle said bars and trays to sequentially draw said draw bars to said receiving positions to register such draw bar notches with said respective exit ends of said pairs of lateral tracks and to positively draw said escort trays inwardly to said transfer positions to engage said pushers with the followers at the entry ends of said lateral tracks and drive the respective followers of said rows of carriages along said passages to drive the followers at the exit ends of said lateral tracks into the respective notches of said draw bars and to then retract said escort trays to said loading position and advance said draw bars to said feed positions thus carrying the followers located in said respective notches to the respective entry ends of said lateral tracks and again advance said escort trays to engage said pushers with the followers in the respective notches to drive them into the respective entry ends of the respective lateral tracks.

2. Shuttle display apparatus as set forth in claim 1 for connection to a second shuttle display apparatus of identical construction and wherein:

said draw bars are formed on their opposite extremities with coupling means for coupling to the draw bars of said second display apparatus such that said actuation of the draw bars of one apparatus will active the draw bars of the other.

3. Shuttle display apparatus as set forth in claim 1 wherein:

said draw bars are formed on the confronting sides with gear teeth; and said drive means includes a drive motor having a shaft, a rocker arm mounted on said shaft between said drive motor and escort trays for reciprocating said trays and a drive gear mounted to said shaft and mounting on its opposite sides with the respective draw bars.

4. Shuttle display apparatus as set forth in claim 1 wherein:

said followers include weight bearing ball bearings mounted in the bottoms thereof for rolling on said bottom walls of said tracks.

5. Shuttle display apparatus as set forth in claim 1 wherein:

said draw bars terminate at their inner respective inner edges with confronting bearing surfaces spaced apart a distance corresponding with aforementioned overall length to, when said notches are out of registration with said lateral tracks, cooperate in maintaining the followers of each row abutted together in close fitting relationship.

* * * * *

UNITED STATES PATENT AND TRADEMARK OFFICE

CERTIFICATE OF CORRECTION

PATENT NO. : 4,688,342

DATED : August 25, 1987

INVENTOR(S) : William R. Bronaugh, Sr. et al.

It is certified that error appears in the above-identified patent and that said Letters Patent is hereby corrected as shown below:

Column 4, line 10, after "notches" insert --are registered with the respective pairs of tracks. The notches--

Signed and Sealed this

Twelfth Day of January, 1988

*Attest:*

*Attesting Officer*

DONALD J. QUIGG

*Commissioner of Patents and Trademarks*